US005110030A

United States Patent [19]

Tanji

[11] Patent Number: 5,110,030

[45] Date of Patent: May 5, 1992

[54] PNEUMATIC FASTENER DRIVING TOOL HAVING AN AIR EXHAUST ARRANGEMENT

[75] Inventor: Isamu Tanji, Katsuta, Japan

[73] Assignee: Hitachi Koki Co., Ltd., Tokyo, Japan

[21] Appl. No.: 734,663

[22] Filed: Jul. 23, 1991

[30] Foreign Application Priority Data

Aug. 10, 1990 [JP] Japan ..... 2-84939[U]
Aug. 24, 1990 [JP] Japan ..... 2-89120[U]

[51] Int. Cl.[5] ..... B25C 1/04

[52] U.S. Cl. ..... 227/130; 227/156; 137/625.69

[58] Field of Search ..... 227/130, 134, 156; 137/625.69; 411/116

[56] References Cited

U.S. PATENT DOCUMENTS

| | | | |
|---|---|---|---|
| 3,288,339 | 11/1966 | Bade | 227/130 |
| 4,039,113 | 8/1977 | Males | 227/130 |
| 4,053,093 | 10/1977 | Thueringer | 227/130 |
| 4,252,261 | 2/1981 | Klaus et al. . | |
| 4,260,092 | 4/1981 | Austin . | |
| 4,260,093 | 4/1981 | Monacelli . | |
| 4,320,864 | 3/1982 | Novak et al. . | |
| 4,341,336 | 7/1982 | Smith . | |
| 4,380,313 | 4/1983 | Klaus et al. . | |
| 4,384,623 | 5/1983 | Galloni . | |
| 4,389,012 | 6/1983 | Grikis et al. . | |
| 4,401,251 | 8/1983 | Nikolich | 227/130 |
| 4,404,894 | 9/1983 | Oesterle . | |
| 4,480,528 | 11/1984 | Shiroyama | 227/130 |
| 5,014,898 | 5/1991 | Heidrich | 227/130 |

FOREIGN PATENT DOCUMENTS

| | | |
|---|---|---|
| 53-28986 | 8/1978 | Japan . |
| 61-191876 | 11/1986 | Japan . |
| 2-152775 | 6/1990 | Japan . |

*Primary Examiner*—Frank T. Yost
*Assistant Examiner*—Scott A. Smith
*Attorney, Agent, or Firm*—Sughrue, Mion, Zinn, Macpeak & Seas

[57] ABSTRACT

A pneumatic fastener driving tool having an elastic cap means for changing compressed air exhausting direction. The cap means has a circular disc shaped top wall and a skirt portion extending from an outer peripheral end portion of the top wall. The skirt portion has a lower portion integrally provided with an annular projection extending radially inwardly. The cap means is elastically deformable and engageable with a casing positioned above a main body portion in which a drive piston is reciprocally disposed. The casing is formed with an annular groove with which the annular projection is engageable. The casing is formed with a fluid passage to allow compressed air in the main body portion to be discharged therethrough to an atmosphere. The cap means is also formed with an exhaust opening in communication with the fluid passage. Upon manual rotation of the cap member against a frictional force given by the engagement between the projection and the groove, an angular position of the exhaust port can be changed.

9 Claims, 5 Drawing Sheets

PNEUMATIC FASTENER DRIVING TOOL HAVING AN AIR EXHAUST ARRANGEMENT

BACKGROUND OF THE INVENTION

The present invention relates to a pneumatic fastener driving tool for ramming down or driving fasteners such as nails etc. into an intended location, and more particularly, to the type thereof having an improved air exhaust arrangement.

A pneumatic fastener driving tool urges an internal drive piston downwardly through a drive source such as a compressed air for driving a nail etc. into a wall or other intended location. The drive piston is reciprocally movable, and therefore, the compressed air applied to an upper portion of the drive piston must be discharged to an atmosphere during return stroke of the piston. To this effect, an exhaust port is formed at an upper portion of the driving tool for allowing the compressed air to be discharged outside.

One example of a conventional pneumatic fastener driving tool is shown in FIG. 1. The tool generally includes a main frame 105, a body portion 102 in which a ramming or driving mechanism such as a drive piston is disposed, and a casing 103 for encasing therein a compressed air exhausting arrangement. The casing 103 is formed with an exhaust port 108 for discharging compressed air therethrough. Further, a cover member 101 formed of a steel plate is attached on an upper portion of the casing 103 by means of a bolt 104 for covering the upper portion of the casing 103 and for defining the exhaust port 108.

With this structure, the cover member 101 generally direct the exhausted compressed air in one direction. Therefore, in some cases of operation modes, exhaust air may be impinged on an operator's face, and the exhaust air may be fling up dust. Further, since the cover member 101 is formed of the steel plate, a sympathetic vibration may occur in relation to the casing 103 due to vibration attendant to the air discharge. Therefore, uncomfortable air exhaust noise may be generated, and crack may also be generated at a fastening portion of the cover member 101 around the bolt 104.

In order to avoid the above described problem, other conventional pneumatic fastener driving tools have been proposed. For example, a driving tool shown in FIG. 2 includes a main frame 105A, a body portion 102A in which a drive piston 107A is reciprocally disposed, and a casing 103A. the driving tool is further provided with a tubular member 101A instead of the cover member 101 shown in FIG. 1. The tubular member 101A is formed with an exhaust passage 108A in communication with an internal space of the casing 103A. The tubular member 101A has an inner portion engageable with an inner surface of the casing 103A, and a coil spring 109A is disposed inside the casing 103A for urging the tubular member 101A in a direction to contact with the inner surface of the casing in order to prevent the air from being leaked through mating surfaces between the tubular member 101A and the casing 103A. The tubular exhaust member 101A has another end formed with an exhaust port directing in a horizontal direction. Therefore, the tubular exhaust member 101A is rotatable about its axis by depressing the same against the biasing force of the spring 109A, so that the air discharging direction can be changed to a desired direction.

Further, according to a still another type conventional arrangement shown in FIG. 3, an air exhaust member 101B formed with an exhaust port is secured to a casing 103B by a bolt 104. The air exhaust member 101B becomes rotatable by unfastening the bolt 104, so that the angular position of the exhaust port can also be changed. Thus, the compressed air in a body portion 102B can be discharged to a desired direction. An O-ring 106 is provided to provide a hermetical seal between the air exhaust member 101B and the casing 103B in order to avoid air leakage into directions other than the exhaust port. Incidentally, reference numerals 105B and 107B designate a main frame and a drive piston, respectively.

In the conventional driving tool shown in FIG. 2, the casing 103B must be detached from the body portion 102A in order to attach the exhaust tubular member 101A, since the latter is supported to the casing 103B at an internal portion thereof. Further, in the another conventional driving tool shown in FIG. 3, the air exhaust member 101B can not be rotated unless the bolt 104 is unfastened. Therefore, a tool is required for unfastening the bolt 104. Moreover, the air exhaust member 101B must be secured by the bolt 104, and the O-ring 106 is additionally required. Therefore, greater numbers of the components are required to render the overall device expensive. Further, even though the air discharging direction can be changed, the problem of noise and crack generation as described above has not yet been solved.

SUMMARY OF THE INVENTION

It is therefore, an object of the present invention to provide an improved cover or cap member, which defines an exhaust passage, capable of being easily attached to or detached from a casing, to thereby reduce numbers of mechanical components and total weight of a resultant pneumatic fastener driving tool with enhanced operability.

This and other objects of the present invention will be attained by providing a pneumatic fastener driving tool comprising (a) a main body portion in which a drive piston is reciprocally movable for driving or ramming a driven member in one direction, a compressed air being applied to the drive piston for its movement in the one direction, (b) a casing positioned above the main body portion, a compressed air exhaust passage being defined within the casing for exhausting the compressed air to an atmosphere for allowing the drive piston to be movable in a second direction opposite the first direction, the casing having an outer peripheral portion being formed with an annular groove, and (c) a cap means formed of an elastic material, the cap means having a cylindrical shape comprising a top wall portion and a cylindrical side wall portion and an annular projection radially inwardly extending from the side wall portion, the annular projection being elastically engageable with the annular groove, the cap means being formed with an exhaust port in communication with the exhaust passage, the cap means being rotatable about its axis overcoming a frictional force given by the elastic engagement between the annular projection and the annular groove for changing an angular position of the exhaust port.

DETAILED DESCRIPTION OF THE PREFERRED EMBODIMENTS

Figure 4:
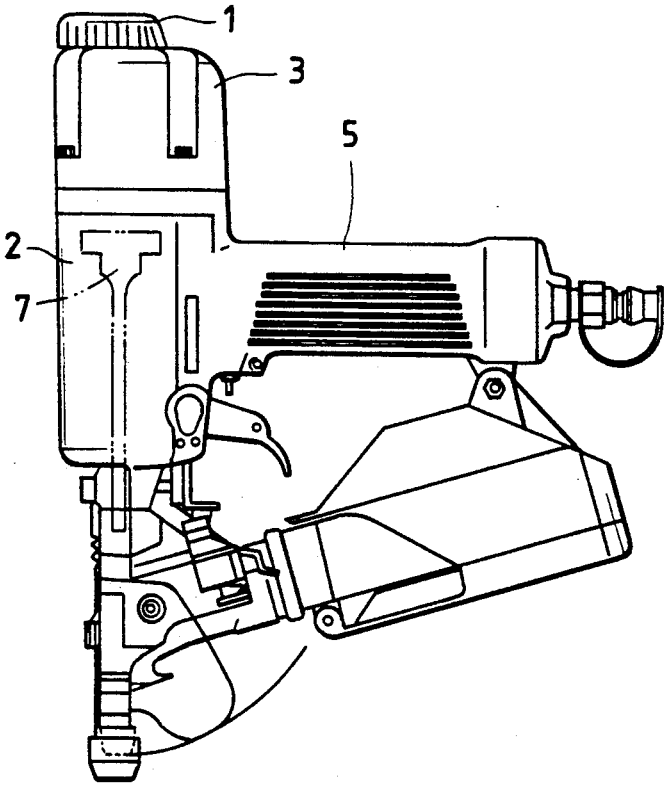
FIG. 4 is a side elevational view showing a pneumatic fastener driving tool according to a first embodiment of this invention.

A pneumatic fastener driving tool according to a first embodiment of this invention will be described with reference to FIGS. 4 through 8. Similar to the conventional arrangement, the pneumatic fastener driving tool generally includes a cover or cap member 1, a body portion 2 in which a drive piston 7 is reciprocally disposed, a casing 3 and a main frame 5 as shown in FIG. 4.

Figure 5:
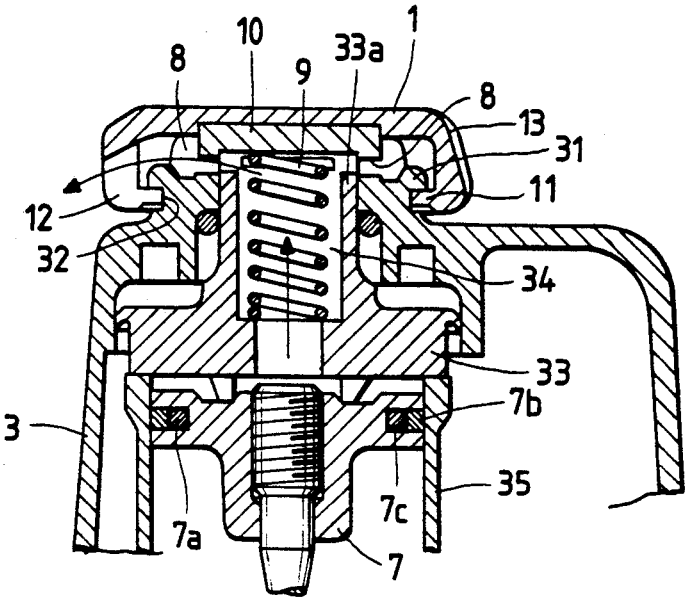
FIG. 5 is a partial cross-sectional elevation showing an essential portion of the pneumatic fastener driving tool according to the first embodiment.

An essential portion is shown in FIG. 5. In a casing 3, a cylinder 35 is disposed in which the drive piston 7 is slidably provided. More specifically, the piston 7 is formed with an annular piston ring groove 7*c* in which an O-ring 7*a* and a piston ring 7*b* in slidable contact with an inner peripheral surface of the cylinder 35 are assembled. Further, a cylinder head 33 is disposed over the cylinder 35. The cylinder head 33 has an upper sleeve portion 33*a* in which a coil spring 9 is disposed for normally urging the cylinder head 33 downwardly. An exhaust passage 34 is defined within the cylinder head 33. A projecting portion 10 of the casing 3 is positioned over the sleeve portion 33*a*, and a passage 8 is formed at a position between a lower face of the projecting portion 10 and an upper end face of the sleeve portion 33*a*. More specifically, during application of the compressed air into the cylinder 33 at a position above the piston 7, the cylinder head 33 is slidingly moved upwardly by the pneumatic force against the biasing force of the coil spring 9, so that the passage 8 is shut off because of the abutment between the lower face of the projecting portion 10 and the upper end face of the sleeve portion 33*a*. On the other hand, in the compressed air exhausting stroke, the cylinder head 33 is moved downwardly by the biasing force of the spring 9. Therefore, the passage 8 is provided to allow fluid communication between the exhaust passage 34 and an internal space of the cap member 1.

Figure 6:
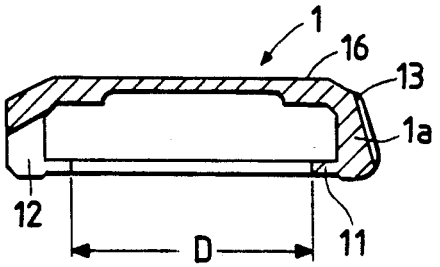
FIG. 6 is a cross-sectional view showing a cover or cap member according to the first embodiment.
Figure 7:
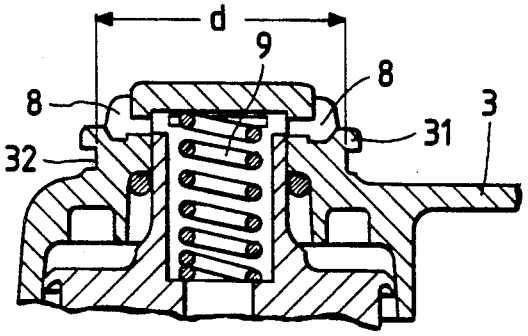
FIG. 7 is a cross-sectional elevation showing the essential portion and a state prior to assembly of the cover or cap member according to the first embodiment.
Figure 8:
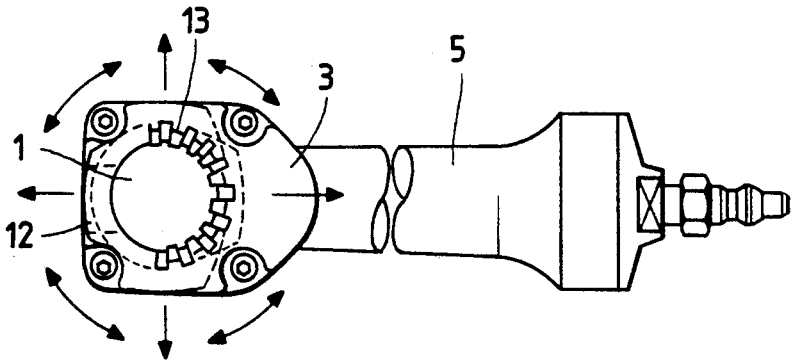
FIG. 8 is a plan view showing the pneumatic fastener driving tool according to the first embodiment.
Figure 9:
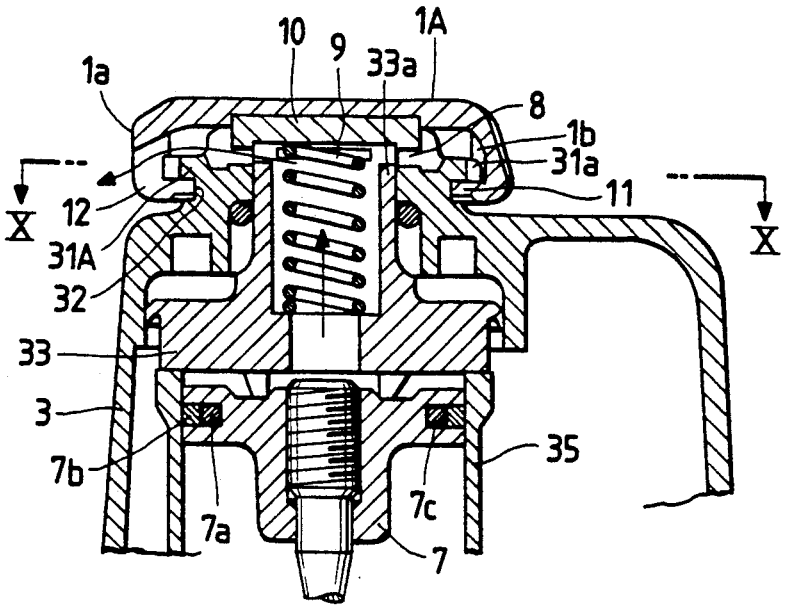
FIG. 9 is a cross-sectional view showing an essential portion of a pneumatic fastener driving tool according to a second embodiment of this invention.

The casing 3 has an upper portion to support an outer peripheral surface of the sleeve portion 33*a*. At an uppermost portion of the casing 3, an annular protrusion 31 is provided so as to define an annular engaging groove 32. Further, the cap member 1 has generally U-shape cross-section as best shown in FIG. 6 having a side wall 1*a* and a top wall 1*b*. At an outer peripheral surface of the side wall 1*a*, a plurality of notched portion 13 are formed as best shown in FIG. 8, On the other hand, at an inner side of the cap member 1, a generally annular projection or a lip portion 11 extends radially inwardly from an edge portion of the side wall 1*a*. The lip portion 11 is elastically engageable with the engaging groove 32. Further, an opening portion 12 is provided at a position inside the cap member 1. Of course, the lip portion 11 is not provided at the opening portion 12. Therefore, air discharge passage can be provided by the combination of the exhaust passage 34 of the sleeve portion 33*a*, the passage 8, and the opening 12 as shown by an arrow in FIG. 5.

Figure 1:
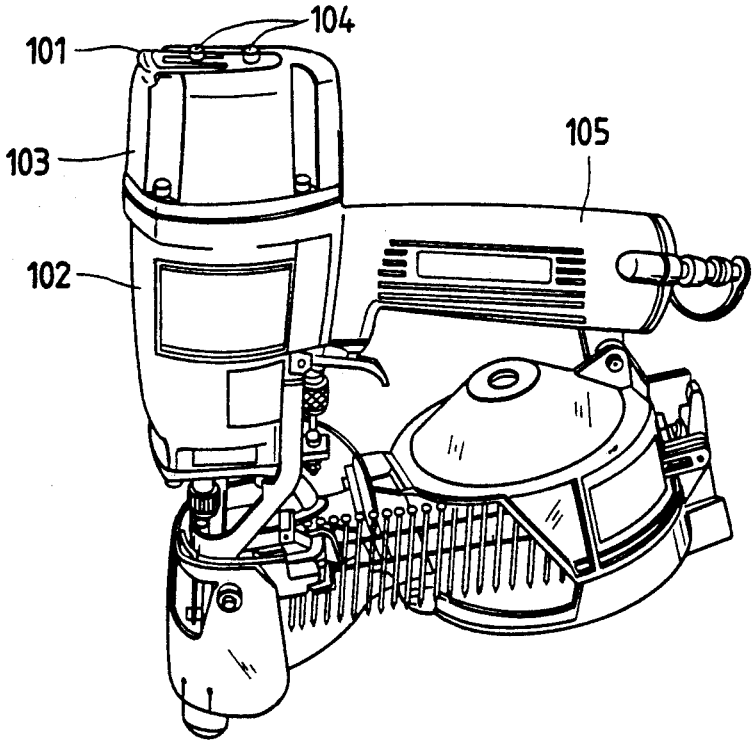
FIG. 1 PRIOR ART
FIG. 1 is a perspective view showing a conventional pneumatic fastener driving tool.
Figure 2:
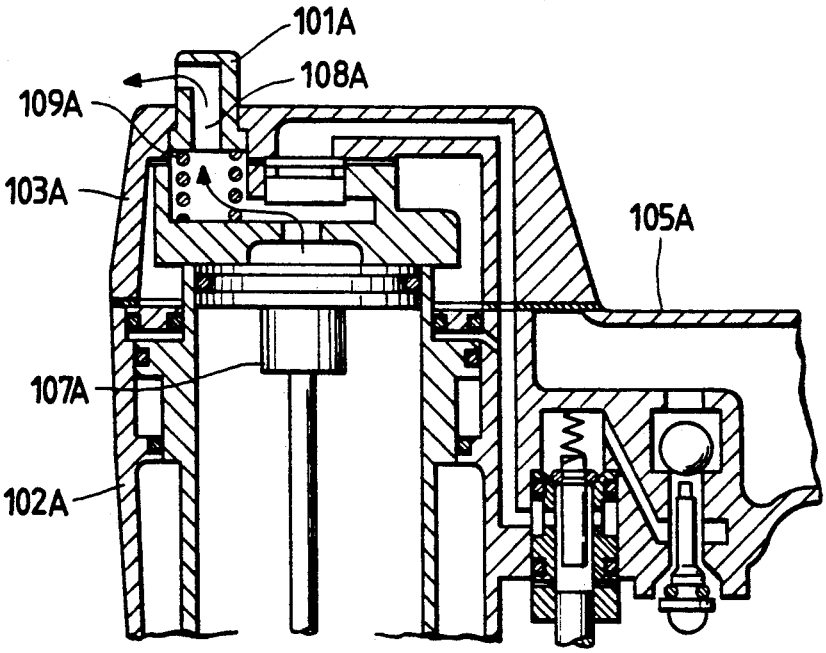
FIG. 2 PRIOR ART
FIG. 2 is a partial cross-sectional elevation showing another example of a conventional pneumatic fastener driving tool.
Figure 3:
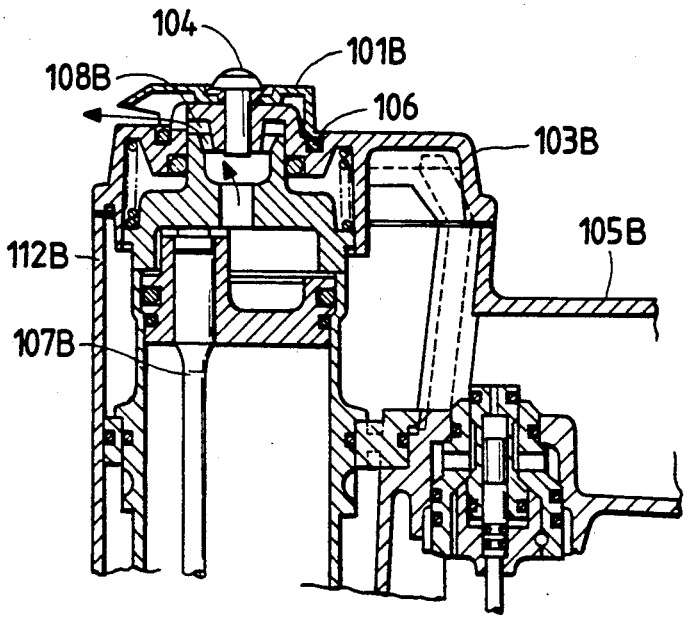
FIG. 3 PRIOR ART
FIG. 3 is a partial cross-sectional elevation showing still another example of a conventional pneumatic fastener driving tool.

The cap member 1 is formed of a flexible or elastic material such as a rubber. An inner diameter D of the lip portion 11 is made smaller than an outer diameter d of the engaging groove 32. For attaching the cap member 1 to the casing 3, the cap member 1 is elastically deformed so as to allow the lip portion 11 to elastically and forcibly engage the engaging groove 32. Upon this engagement, no minute gap or space is provided between the cap member 1 and the casing 3 other than the opening portion 12 because of the difference in the inner and the outer diameters D and d. Accordingly, the exhausted air can be only directed along the air passage without any leakage. Since tight engagement can be provided between the cap 1 and the casing 3, it is unnecessary to use other fixing means such as a bolt 4 (FIG. 1). For the detachment of the cap member 1 from the casing 3, operator's finger is only latched with the notched portion 13 for elastically deforming the cap portion, to thereby disengage the lip portion 11 from the engaging groove 32.

As described above, in the pneumatic fastener driving tool according to the first embodiment, the cap member serving as the means for controlling the air exhausting direction can be easily attached to or detached from the casing without any employment of a fixing member such as a bolt. Accordingly numbers of mechanical components is reduced, to provide a light weight construction with high operability. Further, the angular rotational position of the cap member can be easily manually changed without any employment of tool or without any labor for unfastening a fixing means such as a bolt. Consequently, air exhausting direction can be easily changed.

Next, a pneumatic fastener driving tool according to a second embodiment of this invention will be described with reference to FIGS. 9 through 13, wherein like parts and components are designated by the same reference numerals as those shown in the first embodiment.

In the first embodiment, the cap member 1 formed of the elastic material is force-fitted with the casing 3 at the engagement portions between the lip 11 and the annular groove 32, since the inner diameter D of the lip portion 11 is smaller than the outer diameter d of the groove 32. With this arrangement, the position of the exhaust opening 12 can be changed by controlling an angular position of the cap member 1 with respect to the casing 3 when the cap member 1 is attached thereto. However, if the elasticity of the cap member 1 is insufficient, or if the inner diameter of the lip portion 11 is not sufficiently smaller than the outer diameter of the groove 32, the cap member 1 may be slidingly rotated with respect to the annular groove 32 due to vibration at the time of air exhausting stroke. Accordingly, air cannot be discharged in a desired direction. To avoid this drawback, if the inner diameter of the lip portion 11 is sufficiently smaller than the outer diameter of the annular groove 32, the cap member is excessively firmly fitted with the casing 3. In other words, extremely large sliding resistance may be provided for changing angular rotational position of the cap member 1. Thus, operability may be degraded. In this respect, the second embodiment effects further improvement on the first embodiment.

In the second embodiment, a cap member 1A has a lip portion 11 engageable with an annular groove 32 formed in the casing 3, similar to the first embodiment in order to elastically fix the cap member 1A to the casing 3. Further, in the second embodiment, a plurality of rounded protrusions 31*a* extend radially outwardly from an annular projection 31A at equi-distantly in a circumferential direction thereof. Moreover, a side wall portion 1*a* of the cap member 1A has an inner peripheral surface formed with an equal plurality of dimples 1*b* each engageable with the corresponding rounded protrusion 31*a* as best shown in FIG. 10.

Figure 10:
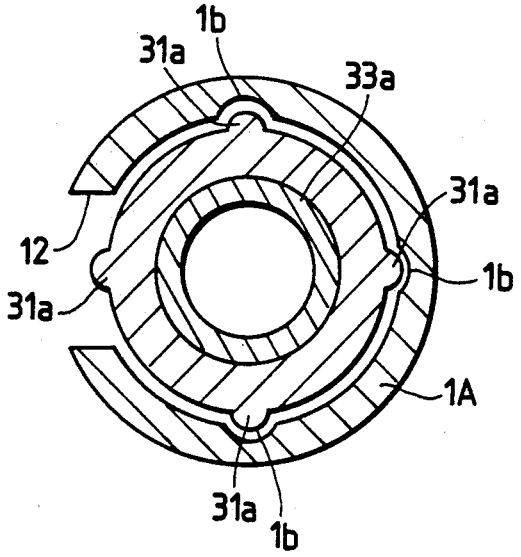
FIG. 10 is a transverse cross-sectional view taken along a line X—X of FIG. 9 showing snapping engagement state between rounded protrusions and dimpled recesses according to the second embodiment.
Figure 11:
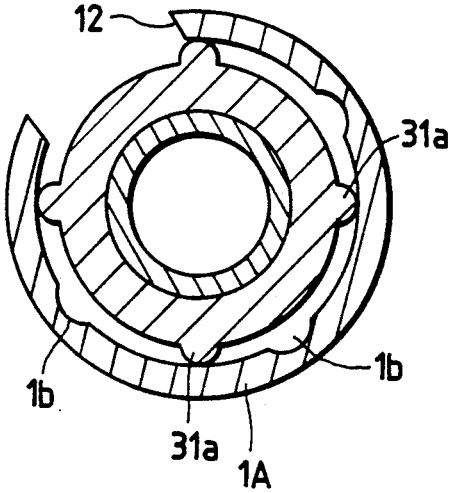
FIG. 11 is a transverse cross-sectional view showing a state in which the rounded protrusions are disengaged from the dimpled recesses according to the second embodiment.

In FIG. 10, even if the cap member 1A is urged to be rotated about its axis due to vibration attendant to the air exhausting operation, this urging force is blocked by the engagement between the rounded protrusions 31*a* and the dimples 1*b*. As a result, the rotation of the cap member 1A can be prevented during operation. Since the cap member 1A is formed of the elastic material such as a rubber, the dimples 1*b* can be easily deformed upon manual rotation force is applied to the cap member 1A. That is, the rounded protrusions 31*a* can be easily disengaged from the dimples 1*b* upon the manual rotation, so that a state shown in FIG. 11 is obtainable in which the rounded protrusions 31*a* ride pass over the dimples and are in intimate contact with the inner surface of the side wall portion 1*a* other than the dimpled portions 1*b*. With this arrangement, angular rotational position of an opening 12 can be easily changed.

Figure 12:
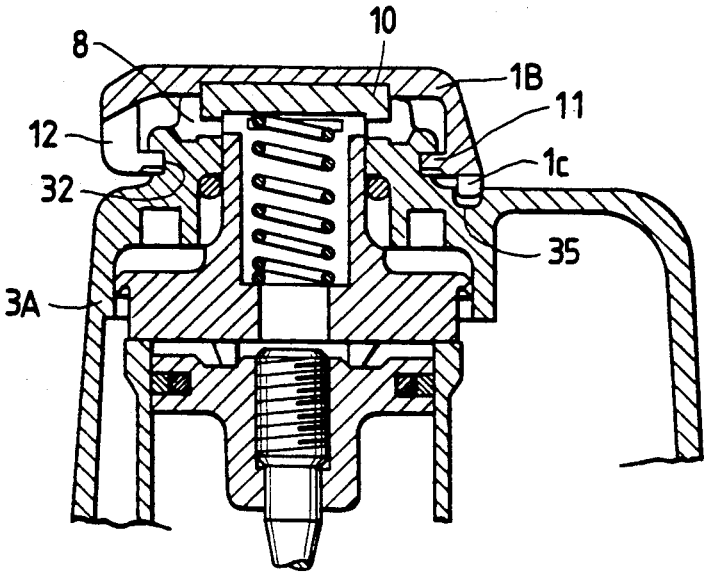
FIG. 12 is a cross-sectional view showing an essential portion of a pneumatic fastener driving tool according to one modification to the second embodiment.

As a first modification to the second embodiment, a top surface portion of the casing 3A is formed with a plurality of dimpled recesses 35, and downwardly extending protrusions 1*c* are provided at a lower end face of the cap member 1B as shown in FIG. 12. The protrusions 1*c* are engageable with the dimpled recesses 35 to fix the angular position of the cap member 1B. With this structure, the angular position of the cap member 1B, i.e., the angular position of the opening 12 can be controlled at a fixed desired position, because of the selective elastic engagement of the protrusions 1*c* with the dimpled recesses 35.

Figure 13:
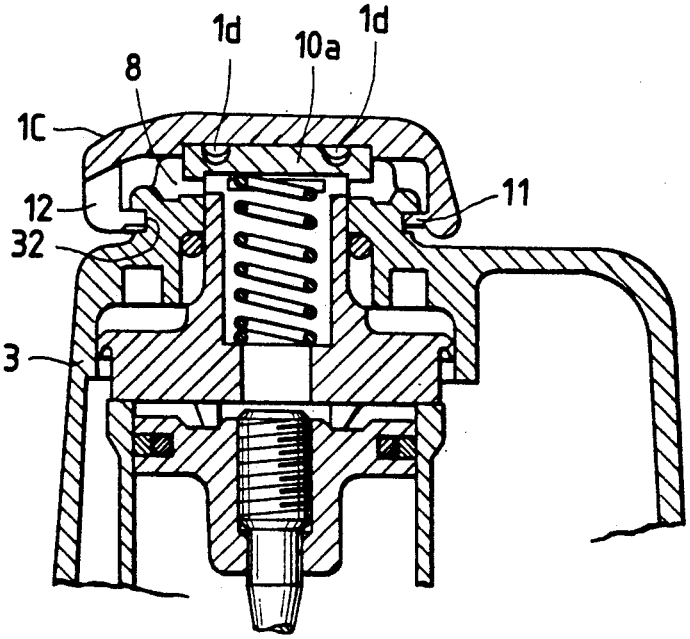
FIG. 13 is a cross-sectional view showing an essential portion of a pneumatic fastener driving tool according to another modification to the second embodiment.

As a second modification, as shown in FIG. 13, a top wall of the cap member 1C is provided with integral rounded protrusions 1*d* extending downwardly from an inner surface of the top wall. Further, an upper surface portion of a segment 10 of the casing 3 is formed with the dimpled recesses 10*a* selectively engageable with the rounded protrusions 1*d*. With this structure, also, the angular rotational position of the cap member 1C is controlled to a desired fixed position.

Thus, according to the second embodiment of this invention, the effect the same as that of the first embodiment is obtainable, since the lip portion 11 is engageable with the annular groove 32 in order to elastically fix the cap member to the casing 3 without any employment of tool and without additional fixing member such as a bolt. Further, in the second embodiment, because of the selective engagement between the rounded protrusions and dimpled recesses, undesirable self rotation of the cap member during air exhausting operation can be prevented. If the air exhausting direction is to be changed, the rounded protrusions are manually disengageable from the corresponding dimpled recesses easily because of the elastic deformations of the dimpled recesses or the rounded protrusions.

While the invention has been described in detail and with reference to specific embodiment thereof, it would be apparent to those skilled in the art that various changes and modifications may be made therein without departing from the spirit and scope of the invention.

What is claimed is:

1. A pneumatic fastener driving tool comprising:

a main body portion in which a drive piston is reciprocally movable for driving or ramming a driven member in one direction, a compressed air being applied to the drive piston for its movement in the one direction;

a casing positioned above the main body portion, a compressed air exhaust passage being defined within the casing for exhausting the compressed air to an atmosphere for allowing the drive piston to be movable in a second direction opposite the first direction, the casing having an outer peripheral portion being formed with an annular groove; and a cap means formed of an elastic material, the cap means having a cylindrical shape comprising a top wall portion and a cylindrical side wall portion and an annular projection radially inwardly extending from the side wall portion, the annular projection being elastically engageable with the annular groove, the cap means being formed with an exhaust port in communication with the exhaust passage, the cap means being rotatable about its axis overcoming a frictional force given by the elastic engagement between the annular projection and the annular groove for changing an angular position of the exhaust port.

2. The pneumatic fastener driving tool as claimed in claim 1, wherein the annular projection has an inner diameter smaller than an outer diameter of the annular groove formed in the casing.

3. The pneumatic fastener driving tool as claimed in claim 2, wherein the side wall portion has an outer surface portion formed with a plurality of notched portions.

4. The pneumatic fastener driving tool as claimed in claim 2, wherein the exhaust port is formed in the side wall portion, the annular projection being discontinuous at a portion where the exhaust port is formed.

5. The pneumatic fastener driving tool as claimed in claim 2, further comprising an elastic locking means for providing an elastically locking engagement of the cap means with the casing, the elastic locking means being provided by at least one rounded protrusion and at least one dimpled recess engageable with the rounded protrusion.

6. The pneumatic fastener driving tool as claimed in claim 5, wherein the at least one dimpled recess is formed in an inner peripheral surface of the side wall, and wherein the casing further comprises an annular ring like protrusion extending radially outwardly at a position immediately adjacent the annular groove, the at least one rounded projection extending radially outwardly from an outer peripheral surface of the annular ring line protrusion.

7. The pneumatic fastener driving tool as claimed in claim 5, wherein the at least one rounded protrusion extends downwardly from an end face of the side wall of the cap means, and wherein the casing further comprises a top wall portion formed with the at least one dimpled recess.

8. The pneumatic fastener driving tool as claimed in claim 5, wherein the at least one rounded protrusion extends downwardly from an inner surface of the top wall of the cap means, and wherein the casing further comprises a top segment having an upper surface formed with at least one dimpled recess.

9. The pneumatic fastener driving tool as claimed in claim 5, wherein a plurality of the dimpled recesses are formed at equi angular distant from each other, and wherein a plurality of the rounded protrusions are provided at equi angular distant from each other to engage corresponding dimpled recess.

* * * * *